US007364466B2

(12) United States Patent
Yen

(10) Patent No.: US 7,364,466 B2
(45) Date of Patent: Apr. 29, 2008

(54) SHORT-CIRCUIT PREVENTIVE UNIVERSAL MEMORY CARD CONNECTOR

(75) Inventor: Ming Hui Yen, Taipei Hsien (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 168 days.

(21) Appl. No.: 11/302,175

(22) Filed: Dec. 14, 2005

(65) Prior Publication Data

US 2007/0134987 A1 Jun. 14, 2007

(51) Int. Cl.
*H01R 24/00* (2006.01)

(52) U.S. Cl. ..... 439/630

(58) Field of Classification Search ..... 439/630, 439/924.1

See application file for complete search history.

(56) References Cited

U.S. PATENT DOCUMENTS 5,653,610 A * 8/1997 Broschard, III ..... 439/630
7,052,325 B2 * 5/2006 Lin et al. ..... 439/630
7,059,909 B1 * 6/2006 Tseng et al. ..... 439/630
7,083,473 B1 * 8/2006 Lai ..... 439/630
7,204,718 B2 * 4/2007 Lai ..... 439/630
2004/0106326 A1 * 6/2004 Hsieh ..... 439/630
2006/0116027 A1 * 6/2006 Tseng et al. ..... 439/630
2006/0216999 A1 * 9/2006 Hsiao ..... 439/630
2007/0054560 A1 * 3/2007 Lai ..... 439/630
2007/0077822 A1 * 4/2007 Tanaka et al. ..... 439/630

* cited by examiner

*Primary Examiner*—Gary F. Paumen
(74) *Attorney, Agent, or Firm*—Bacon & Thomas, PLLC

(57) ABSTRACT

A memory card connector having an electrically insulative casing covered with a top cover to house first pins at the front side for the contact of a XD memory card, second pins at the rear side for the contact of a MS memory card, and third pins on the middle for the contact of other memory cards. The casing has an elongated slot in the bottom wall, and a spring arm with a protruding block suspending in the elongated slot to hold the power pin of the first pins, for enabling the power pin to be lowered with the spring arm into the elongated slot to prevent the occurrence of a short circuit accidentally upon insertion of a memory card that is not a XD memory card.

3 Claims, 7 Drawing Sheets

SHORT-CIRCUIT PREVENTIVE UNIVERSAL MEMORY CARD CONNECTOR

BACKGROUND OF THE INVENTION (a) Field of the Invention

The present invention relates to memory card connectors and more particularly, to a universal memory card connector, which prevents a short circuit.

(b) Description of the Prior Art:

Under continuous study and research, memory card manufacturers have developed a variety of versatile memory cards such as XD memory card, MS memory card, SD memory card, MMC memory card, CF memory card. These memory cards are not compatible. In order to receive different memory cards, adapter cards and universal memory card connectors are developed. FIGS. 8 and 9 show a conventional adapter card 10, which comprises a front plug unit 101, an electrically insulative bottom cover shell 104 extending from the rear side of the front plug unit 101, and a metal top cover shell 105 covered on the electrically insulative bottom cover shell 104 and defining with the electrically insulative bottom cover shell 104 an insertion chamber for the insertion of different memory cards. The front plug unit 101 has two grounding strips 102 and gold fingers 103. The electrically insulative bottom cover shell 104 has pins 106 arranged in parallel and respectively electrically connected to the gold fingers 103. When inserted a memory card 20 into the insertion chamber in between the electrically insulative bottom cover shell 104 and the metal top cover shell 105, the inserted memory card 20 is kept in contact with the pins 106. By means of the plug unit 101, the adapter card 10 can be connected to a memory card connector.

FIG. 10 shows a conventional universal memory card connector 30, which has multiple sets of pins arranged therein for the contact of different memory cards. This universal memory card connector 30 has a metal top cover shell 105 that covers a part of the bottom wall of the bottom cover shell 104. The metal top cover shell 105 is coated with a layer of insulative coating. However, the insulative coating of the metal top cover shell 105 tends to be rubbed away after a long use of the universal memory card connector 30. When inserted the aforesaid adapter card 10 into this universal memory card connector 30, the metal top cover shell 105 is kept in contact with the grounding strips 102 and the power pin 401 of the set of first pins 40, and a short circuit may occur at this time if the insulative coating of the metal top cover shell 105 is rubbed away.

SUMMARY OF THE INVENTION

The present invention has been accomplished under the circumstances in view. It is one object of the present invention to provide a universal memory card connector with multiple sets of pins, which automatically forces the power pin of the first set of pins downwards to prevent a short circuit upon the insertion of a memory card or adapter card to be set into contact with another set of pins. It is another object of the present invention to provide a universal memory card connector, which uses one power pin for the first set of pins to achieve transmission of power supply, and a spring arm to hold down the power pin, for enabling the power pin to be lowered with the spring arm to prevent a short circuit upon insertion of a memory card to be set into contact with another set of pins.

To achieve these and other objects of the present invention, the memory card connector comprises an electrically insulative casing, the electrically insulative casing having a bottom wall, two sidewalls at two opposite lateral sides of the bottom wall, and an insertion chamber defined between the sidewalls above the bottom wall, a top cover covering the electrically insulative casing, and multiple pin sets mounted inside the insertion chamber for the contact of different memory cards and an adapter card selectively, the multiple pin sets comprising a set of first pins arranged in parallel on the bottom wall inside the insertion chamber at a front side, a set of second pins arranged in parallel on the bottom wall inside the insertion chamber at a rear side, and a set of third pins arranged in parallel on the bottom wall inside the insertion chamber between said set of first pins and the set of second pins.

The electrically insulative casing has an elongated slot cut through the bottom wall and axially extending in direction from a front side of the insertion chamber toward a rear side of the insertion chamber, and a spring arm formed integral with the bottom wall and suspending the elongated slot. The spring arm has a fixed end connected to one end of the elongated slot, a free end suspending in the elongated slot and terminating in a protruding block, and a retaining notch spaced between the fixed end and the free end at one lateral side. The set of first pins includes a power pin disposed at one side. The power pin has a contact portion engaged into the retaining notch of the spring arm for allowing the power pin to be moved downwards with the spring arm upon insertion of a memory card or adapter card that is adapted to contact one of the set of second pins and the set of third pins, preventing accidental contact of the metal shell of the inserted memory card or adapter card with the power pin accidentally.

DETAILED DESCRIPTION OF THE PREFERRED EMBODIMENT

Figure 1:
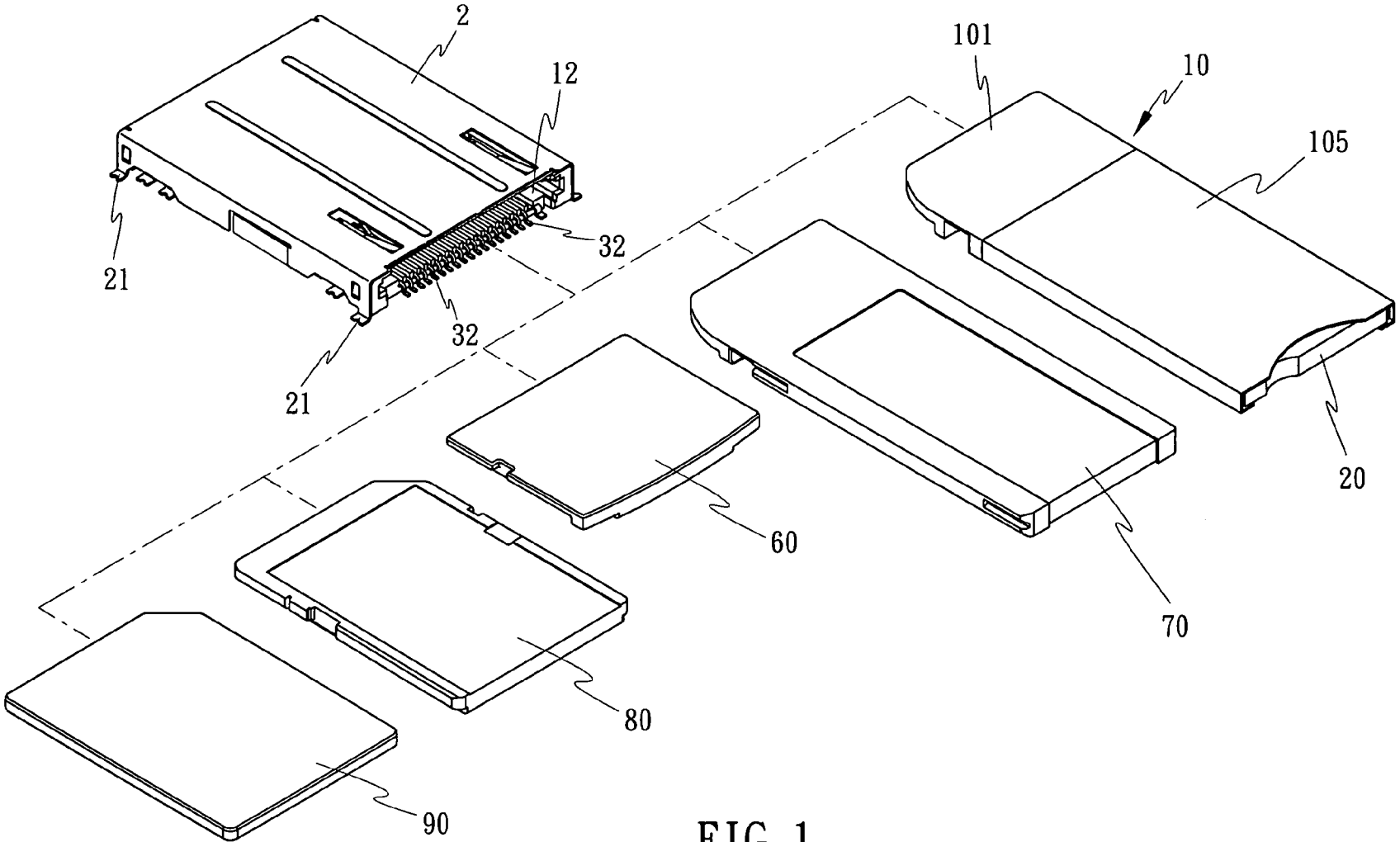
FIG. 1 is a schematic drawing, showing a universal memory card connector for use with different memory cards and an adapter card selectively according to the present invention.

Referring to the annexed drawings in detail, a card connector in accordance with the present invention is shown compatible to XD memory card 60, MS memory card 70, SD memory card 80 and MMC memory card 90, comprised of an electrically insulative casing 1, a top cover 2, and multiple pin sets 3~5.

Figure 2:
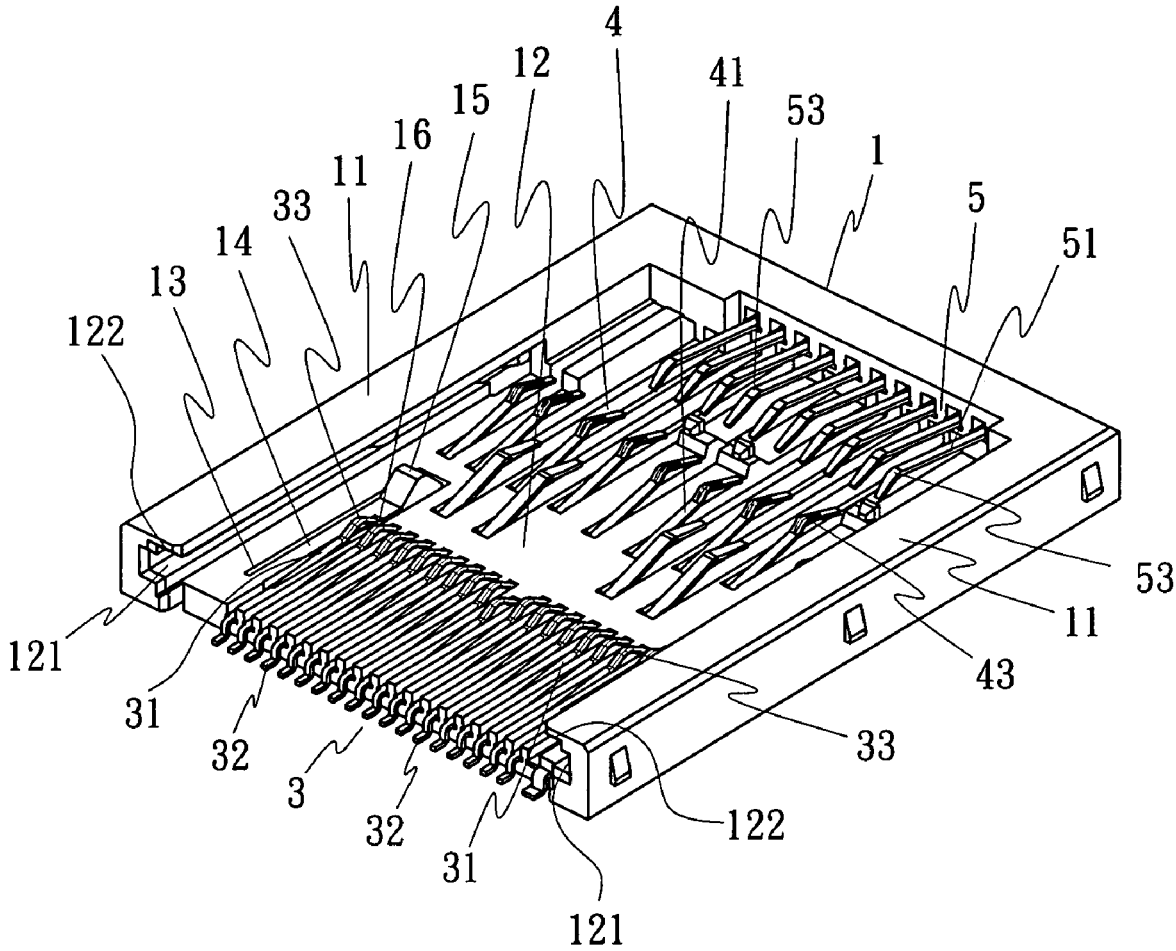
FIG. 2 is a perspective view of the universal memory card connector according to the present invention after removal of the top cover.
Figure 3:
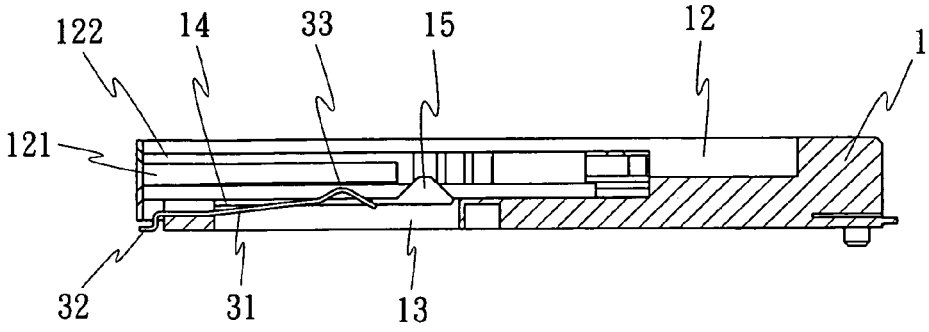
FIG. 3 is a sectional side view of the universal memory card connector according to the present invention.

Referring to FIGS. 1~3, the electrically insulative casing 1 has two opposite sidewalls 11, an insertion chamber 12 defined between the two opposite sidewalls 11, a plurality of guide grooves 121 and 122 bilaterally formed in the insertion chamber 12, an elongated slot 13 cut through the bottom wall of the insertion chamber 12, and a spring arm 14 formed integral with the bottom wall of the insertion chamber 12 and suspending the elongated slot 13. The spring arm 14 has one end connected to one end of the elongated slot 13, and the other end (the free end) suspending in the elongated slot 13 and terminating in a protruding block 15. Further, the spring arm 14 has a retaining notch 16 at one side.

The top cover 2, as shown in FIG. 1, is a ⊓-shaped metal cover shell, having a plurality of bottom grounding strips 21. When covered the top cover 2 on the casing 1, the bottom grounding strips 21 of the top cover 2 are kept at the bottom side of the casing 1.

The set pin set 3, as shown in FIGS. 2 and 3, is for the contact of a XD memory card, including a number of first pins 31 mounted in the front side of the insertion chamber 12 of the casing 1 and arranged in parallel, each having a bonding portion 32 disposed at one end and extending out of the front bottom side of the insertion chamber 12 and a contact portion 33 extending axially inwards along the bottom wall of the insertion chamber 12 and raised from the top side of the bottom wall of the insertion chamber 12. The first pins 31 include one power pin 31' disposed adjacent to the spring arm 14. The contact portion 33 of the power pin 31' is engaged into the retaining notch 16 of the spring arm 14, allowing the power pin 31' to be pressed down by the spring arm 14.

The second pin set 4, as shown in FIG. 2, is for the contact of a MS memory card, including a number of second pins 41 mounted in the bottom wall of the insertion chamber 12 of the casing 1 at the rear side and arranged in parallel, each having a bonding portion (not shown) extended out of the casing 1 and a contact portion 43 raised from the top side of the bottom wall of the insertion chamber 12.

The third pin sets 5, as shown in FIG. 2, is for the contact of other memory cards, including a number of third pins 51 mounted in the bottom wall of the insertion chamber 12 of the casing 1 and arranged in parallel between the first pin set 3 and the second pin set 4, each having a bonding portion (not shown) extended out of the casing 1 and a contact portion 53 raised from the top side of the bottom wall of the insertion chamber 12.

Therefore, the aforesaid electrically insulative casing 1, top cover 2 and pins 3~5 form the short circuit preventive universal memory card connector (see FIG. 1). The spring arm 14 holds down the power pin 31' is one of the important features of the present invention. This design of memory card connector is suitable for the installation of a XD memory card 60, a MS memory card 70, a SD memory card 80, or a MMC memory card 90.

Figure 4:
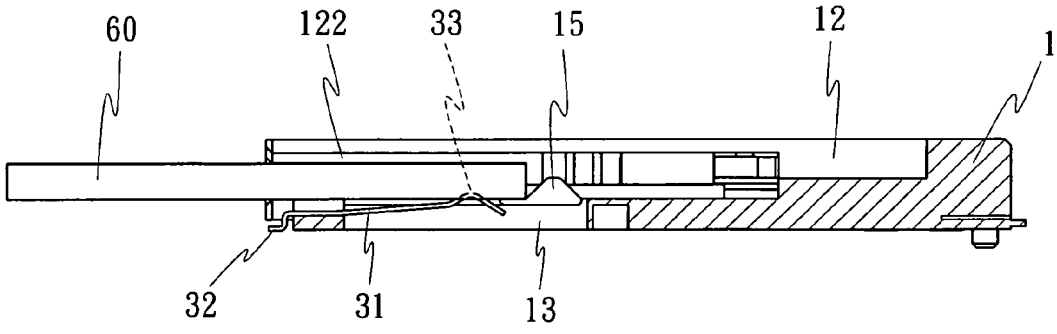
FIG. 4 is a schematic drawing showing a XD memory card inserted into the insertion chamber of the universal memory card connector according to the present invention.

Referring to FIG. 4, when inserting a XD memory card 60 into the insertion chamber 12, the guide grooves 121 guides the inserted XD memory card 60 into position, keeping the inserted XD memory card 60 to be supported on the first pins 3 and stopped at the front side of the protruding block 15 of the spring arm 14, and therefore the inserted XD memory card 60 is kept electrically coupled to the first pins 31 of the first pin set 3.

Figure 5:
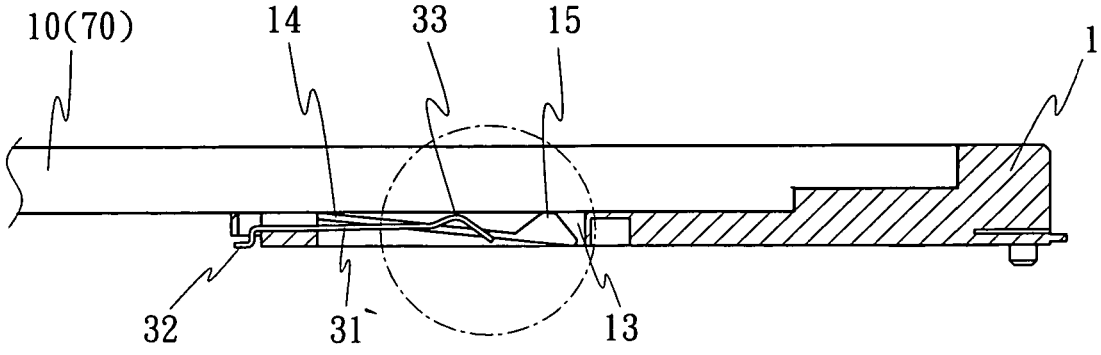
FIG. 5 is a schematic drawing showing a MS memory card (adapter card) inserted into the insertion chamber of the universal memory card connector according to the present invention.
Figure 6:
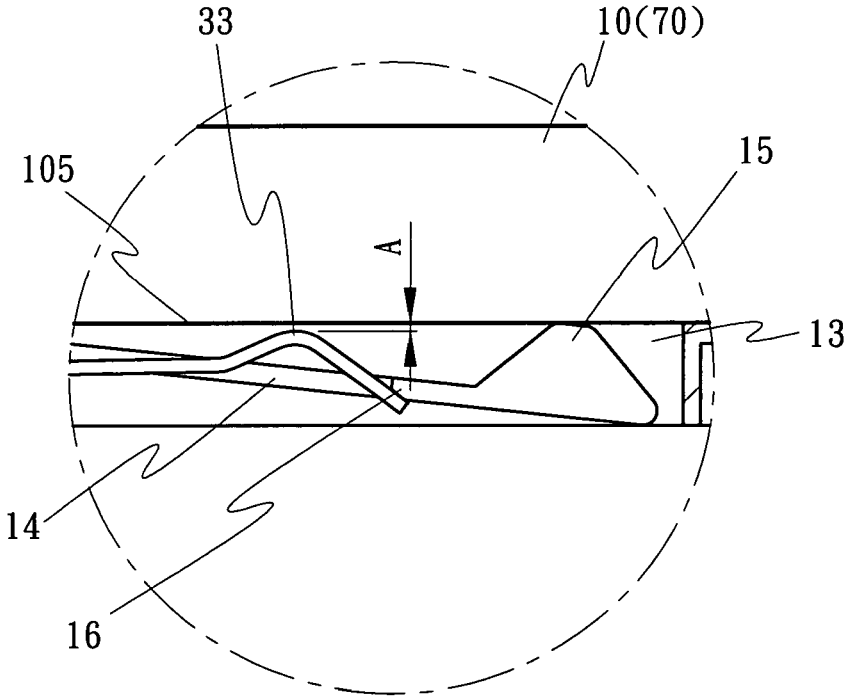
FIG. 6 is an enlarged view of a part of FIG. 5.
Figure 7:
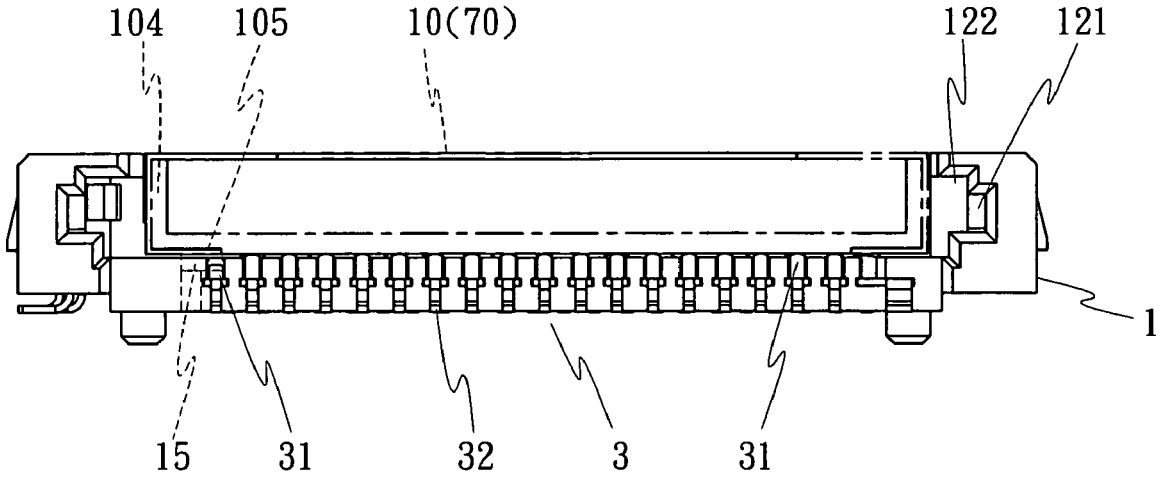
FIG. 7 is a schematic sectional view showing the inserted adapter card kept away from the power pin according to the present invention.
Figure 8:
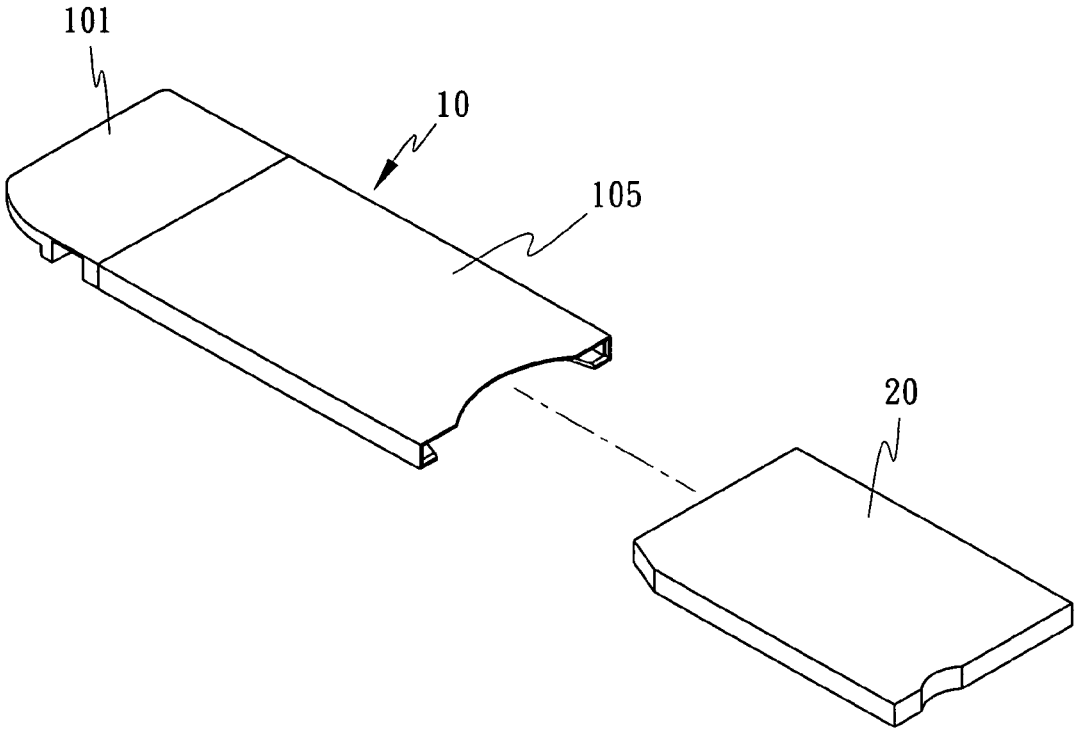
FIG. 8 is a schematic drawing showing the use of an adapter card with a memory card according to the prior art.
Figure 9:
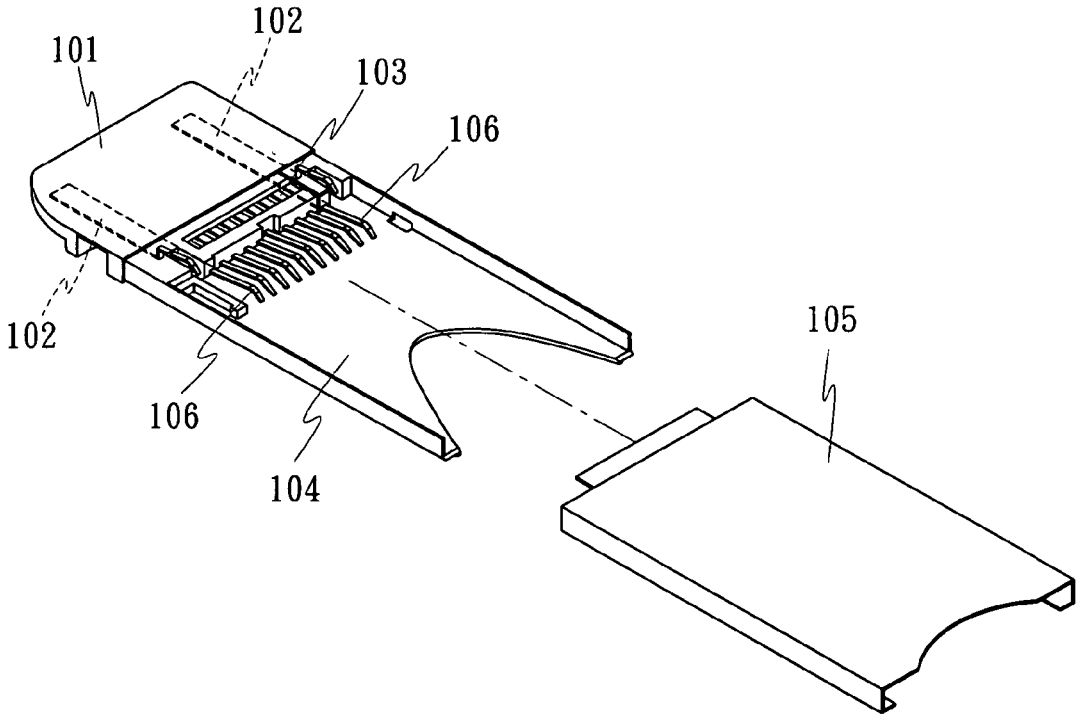
FIG. 9 is an exploded view of the adapter card shown in FIG. 8.
Figure 10:
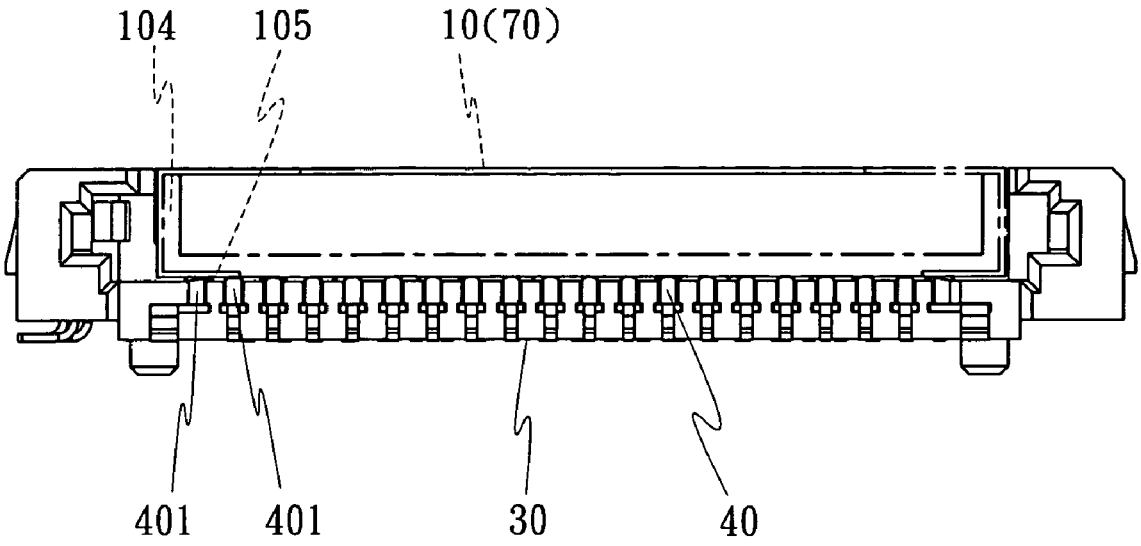
FIG. 10 is a schematic sectional view showing the inserted adapter card kept in contact with the power pin according to the prior art.

Referring to FIGS. 5 and 6, when inserted a MS memory card 70 or a conventional adapter card 10 into the insertion chamber 12, the inserted MS memory card 70 or adapter card 10 is pressed on the protruding block 15 of the spring arm 14 to force the spring arm 14 and the power pin 31' into the inside of the elongated slot 13, and therefore, as shown in FIG. 6, the power terminal 31' is kept away from the metal shell 105 of the inserted MS memory card 70 or adapter card 10 at a space A, preventing a short circuit due to an accidental touch.

Referring to FIG. 2 again, the first pin set 3 has only one power pin 31'. According to conventional designs, two power pins are used. Actually, one power pin is sufficient to achieve connection of electricity. Therefore, the invention uses only one power pin 31' that is linked to the spring arm 14 to prevent contact of the metal shell 105 of a different memory card or the adapter card 105 accidentally that will cause a short circuit.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A memory card connector comprising an electrically insulative casing, said electrically insulative casing having a bottom wall, two sidewalls at two opposite lateral sides of said bottom wall, and an insertion chamber defined between said sidewalls above said bottom wall, a top cover covering said electrically insulative casing, and multiple pin sets mounted inside said insertion chamber for the contact of different memory cards and an adapter card selectively, said multiple pin sets comprising a set of first pins arranged in parallel on the bottom wall inside said insertion chamber at a front side, a set of second pins arranged in parallel on the bottom wall inside said insertion chamber at a rear side, and a set of third pins arranged in parallel on the bottom wall inside said insertion chamber between said set of first pins and said set of second pins, wherein:

said electrically insulative casing has an elongated slot cut through said bottom wall and axially extending in direction from a front side of said insertion chamber toward a rear side of said insertion chamber, and a spring arm formed integral with said bottom wall and suspending said elongated slot, said spring arm having a fixed end connected to one end of said elongated slot, a free end suspended in said elongated slot and terminating in a protruding block, and a retaining notch spaced between said fixed end and said free end at one lateral side; said set of first pins include a power pin disposed at one side, said power pin having a contact portion engaged into said retaining notch of said spring arm for allowing said power pin to be moved downwardly with said spring arm upon insertion of a memory card or adapter card that is adapted to contact one of said set of second pins and said set of third pins, preventing accidental contact of the metal shell of the inserted memory card or adapter card with said power pin accidentally.

2. The memory card connector as claimed in claim 1, wherein the fixed end of said spring arm is connected to one end of said elongated slot adjacent to the front side of said insertion chamber, and the free end of said spring arm is suspending in said elongated slot near an opposite end of said elongated slot and the rear sided of said insertion chamber.

3. The memory card connector as claimed in claim 1, wherein said first pins are adapted for the contact of a XD memory card; said second pins are adapted for the contact of a MS memory card or an adapter card; said third pins are adapted for the contact of other different memory cards.

* * * * *